US008315530B2

(12) United States Patent
Ichikawa

(10) Patent No.: US 8,315,530 B2
(45) Date of Patent: Nov. 20, 2012

(54) FIXING DEVICE AND IMAGE FORMING DEVICE

(75) Inventor: Junichi Ichikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 280 days.

(21) Appl. No.: 12/469,230

(22) Filed: May 20, 2009

(65) Prior Publication Data

US 2010/0150622 A1 Jun. 17, 2010

(30) Foreign Application Priority Data

Dec. 17, 2008 (JP) ..... 2008-321091

(51) Int. Cl.
*G03G 15/20* (2006.01)

(52) U.S. Cl. ..... 399/33

(58) Field of Classification Search ..... 399/33, 399/122, 328, 329, 331
See application file for complete search history.

(56) References Cited

U.S. PATENT DOCUMENTS

| | | | | |
|---|---|---|---|---|
| 2005/0111862 | A1* | 5/2005 | Fuma et al. | 399/67 |
| 2006/0165429 | A1* | 7/2006 | Satoh et al. | 399/69 |
| 2007/0189819 | A1 | 8/2007 | Uehara et al. | |
| 2007/0212093 | A1 | 9/2007 | Maeda et al. | |
| 2008/0205948 | A1 | 8/2008 | Baba et al. | |

FOREIGN PATENT DOCUMENTS

| | | |
|---|---|---|
| CN | 101021709 | 8/2007 |
| CN | 101251741 | 8/2008 |
| JP | 2006-243424 | 9/2006 |
| JP | 2007-241143 | 9/2007 |
| JP | 2008-225173 | 9/2008 |

OTHER PUBLICATIONS

Chinese Patent Office Action; Chinese Patent Application No. 200910142446.7; issued Apr. 27, 2012; and the English translation thereof.
Abstract of CN101251741.
Abstract of CN101201709.

* cited by examiner

*Primary Examiner* — Walter L Lindsay, Jr.
*Assistant Examiner* — Barnabas Fekete
(74) *Attorney, Agent, or Firm* — Fildes & Outland, P.C.

(57) ABSTRACT

A fixing device includes a heating roller that is internally provided with a heat source member and is rotated by a drive unit; an endless fixing belt that is entrained around the heating roller and heated thereby, and is provided with a surface layer that contacts a recording medium, and the yield stress of a material forming the surface layer is varied according to the temperature of the material; a pressure member that is provided facing the heating roller and presses the recording medium, on which a toner image has been formed, against the fixing belt; a travel direction alteration member that contacts the fixing belt and changes the direction of travel of the fixing belt by bending the fixing belt; and a drive control section that operates the drive unit and rotates the heating roller after the heating roller has been heated such that the endless fixing belt is heated by the heating roller to a predetermined temperature where the yield stress of a material forming the surface layer of the fixing belt is larger than the stress acting on the surface layer when the travel direction of the fixing belt is altered by the travel direction alteration member.

4 Claims, 7 Drawing Sheets

FIXING DEVICE AND IMAGE FORMING DEVICE

CROSS-REFERENCE TO RELATED APPLICATIONS

This application is based on and claims priority under 35 USC 119 from Japanese Patent Application No. 2008-321091 filed on Dec. 17, 2008.

BACKGROUND OF THE INVENTION

Technical Field

The present invention relates to a fixing device and to an image forming device.

SUMMARY

A fixing device according to a first aspect of the present invention includes a heating roller that is internally provided with a heat source member and is rotated by a drive unit; an endless fixing belt that is entrained around the heating roller and heated thereby, is provided with a surface layer that contacts a recording medium, and the yield stress of a material forming the surface layer is varied according to the temperature of the material; a pressure member that is provided facing the heating roller and presses the recording medium, on which a toner image has been formed, against the fixing belt; a travel direction alteration member that contacts the fixing belt and changes the direction of travel of the fixing belt by bending the fixing belt; and a drive control section that operates the drive unit and rotates the heating roller after the heating roller has been heated, such that the endless fixing belt is heated by the heating roller to a predetermined temperature where the yield stress of the material forming the surface layer of the fixing belt is larger than the stress acting on the surface layer when the travel direction of the fixing belt is altered by the travel direction alteration member.

BRIEF DESCRIPTION OF THE DRAWINGS

Embodiments of the present invention will be described in detail based on the following figures, wherein.

DESCRIPTION

An example of an image forming device incorporating the fixing device according to an exemplary embodiment of the present invention is explained with reference to FIGS. 1-7.

Overall Configuration

Figure 7:
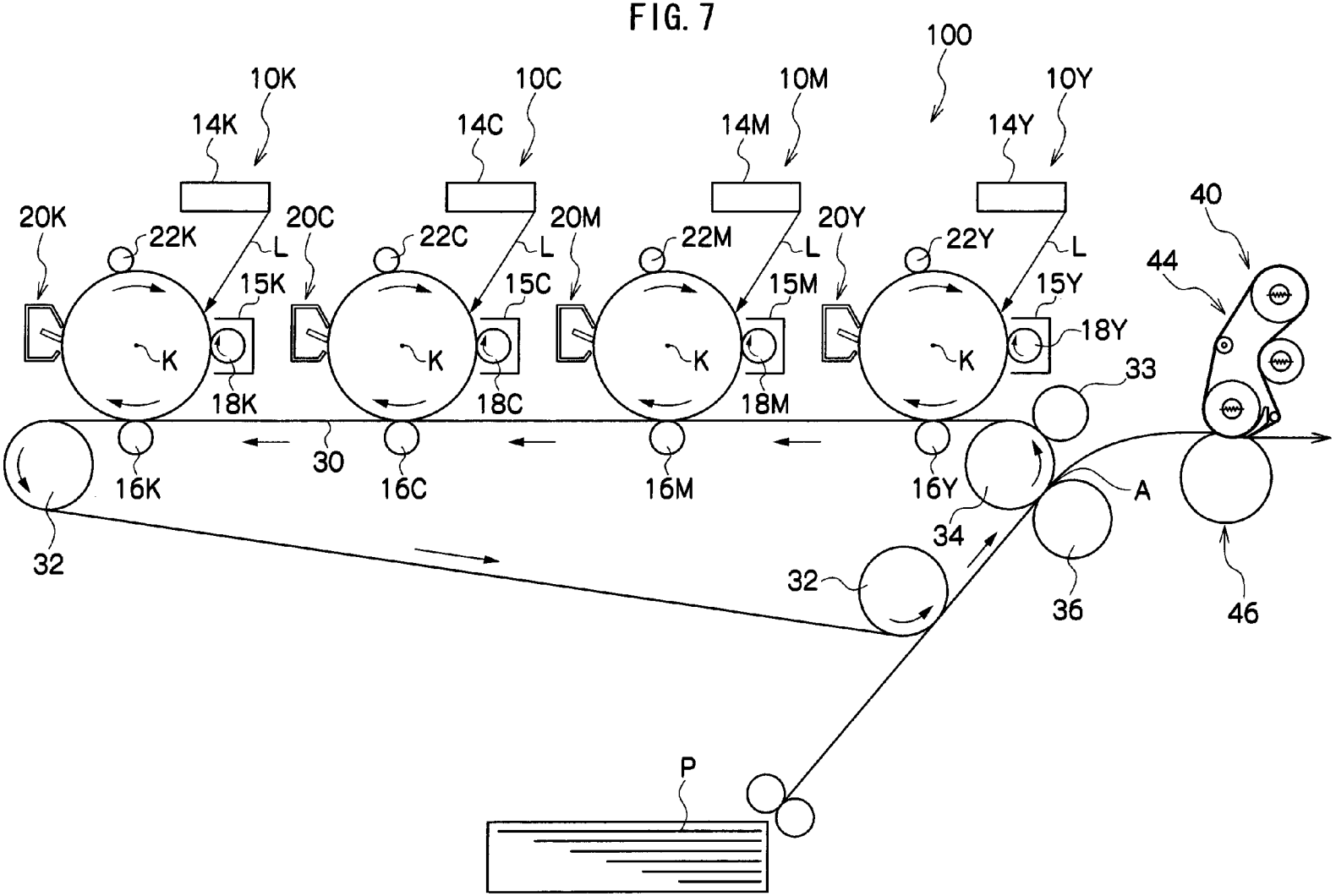
FIG. 7 shows the schematic configuration of an image forming device incorporating the fixing device according to the exemplary embodiment of the present invention.

As shown in FIG. 7, image forming device 100 performs image processing based on color image information sent from an image data input device such as a personal computer (not shown) and forms a color image on sheet member P, which is a recording medium, using an electrophotographic system.

Image forming device 100 is provided with image forming units 10Y, 10M, 10C and 10K that form toner images in the colors of yellow (Y), magenta (M), cyan (C) and black (K), respectively. In the following, when it is necessary to distinguish between image forming units of the respective colors, the letters Y, M, C and K are added to the reference numeral 10 as appropriate, and when such distinction is not necessary the letters Y, M, C and K are omitted.

Image forming units 10Y, 10M, 10C and 10K are arranged in series in this order with respect to the direction of movement of endless intermediate transfer belt 30, which is disposed in a tensioned state around support roller 34 and plural tension rollers 32. Intermediate transfer belt 30 passes between photosensitive drums 12Y, 12M, 12C and 12K, which are image holding bodies of the respective image forming units 10Y, 10M, 10C and 10K, and primary transfer rollers 16Y, 16M, 16C and 16K that are disposed in opposition to the respective photosensitive drums.

Next, the configuration and image formation operations of the respective image forming units 10Y, 10M, 10C and 10K are explained by description of image forming unit 10Y, which forms a yellow toner image.

Image forming unit 10Y is provided with charge roller 22Y, which contacts and uniformly charges the surface of photosensitive drum 12Y, and with exposure device 14Y, which performs image exposure on the surface of the uniformly charged photosensitive drum 12Y and forms an electrostatic latent image that corresponds to a yellow image.

Further, developing device 15Y is provided, which is equipped with developing roller 18Y that uses toner to visualize the electrostatic latent image corresponding to a yellow image as a yellow toner image. Primary transfer roller 16Y is provided, which performs primary transfer of the yellow toner image onto intermediate transfer belt 30 by means of electrostatic attraction resulting from an applied transfer bias.

Further, the yellow toner image is not completely transferred to intermediate transfer belt 30 in the primary transfer and a portion thereof remains on photosensitive drum 12Y as transfer residual yellow toner. In addition, toner external additives and the like are attached to the surface of photosensitive drum 12Y. Therefore, photosensitive body cleaner 20Y, which removes transfer residual toner and the like from the surface of photosensitive drum 12Y, is provided so as to contact photosensitive drum 12Y, and when photosensitive drum 12Y passes a position opposed to photosensitive body cleaner 20Y after the primary transfer, transfer residual toner and the like on the surface of photosensitive drum 12Y are removed. Then, the surface of photosensitive drum 12Y is charged again by charge roller 22Y in preparation for the next image formation cycle.

The same image formation process as above is performed at each of the image forming units 10Y, 10M, 10C and 10K at a timing that takes account of the differences in the relative positions of the respective image forming units 10Y, 10M, 10C and 10K, and toner images of the respective colors Y, M, C and K are successively formed on intermediate transfer belt 30, providing a multiple toner image.

Sheet member P is transported to secondary transfer position A at a predetermined timing. Secondary transfer roller 36 is provided at secondary transfer position A and transfer bias is applied to secondary transfer roller 36. The multiple toner image formed on intermediate transfer belt 30 is transferred to sheet member P all at once by the electrostatic attraction force of secondary transfer roller 36.

In addition, fixing device 40 is provided, which fixes the formed multiple toner image to sheet member P by means of heat and pressure.

Configuration of Main Portion

Next, fixing device 40 is explained in detail.

Figure 1:
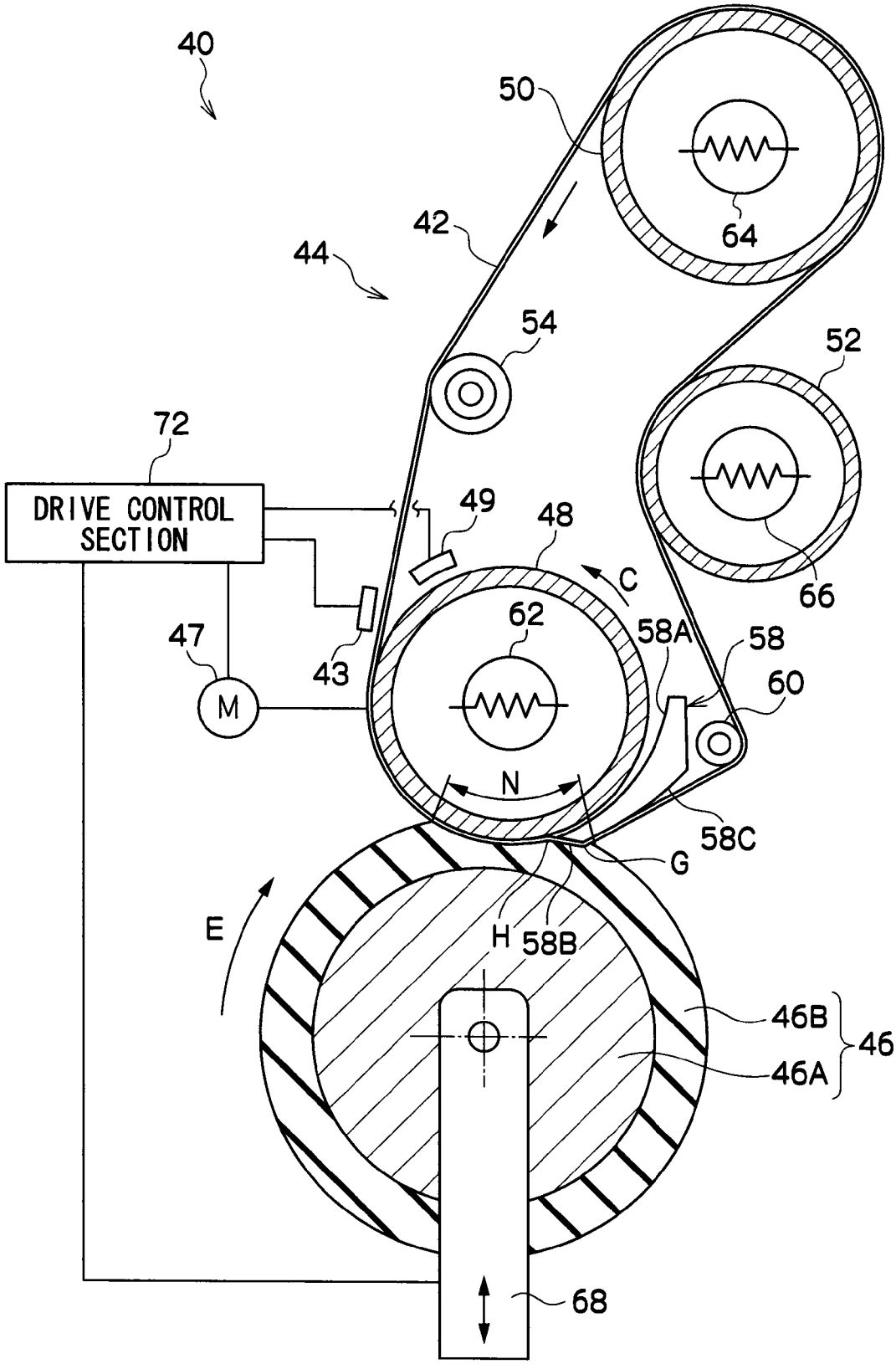
FIG. 1 is a sectional view showing a fixing device according to an exemplary embodiment of the present invention.

As shown in FIG. 1, fixing device 40 is configured by fixing belt module 44 provided with fixing belt 42, and a pressure member such as pressure roller 46, which is a member for application of pressure and is disposed in pressure-contact with fixing belt module 44. Nip portion N, at which the toner image is fixed to sheet member P by application of pressure and heat, is formed between fixing belt module 44 and pressure roller 46.

Fixing belt module 44 is provided with heating roller 48, which, in addition to tensioning fixing belt 42, rotates and drives as a result of the drive force of motor 47, and tension roller 50, which tensions fixing belt 42 from the inside thereof. Further, tension roller 52, which is disposed at an outer side of fixing belt 42 and which regulates the rotational trajectory thereof, and orientation correction roller 54, which corrects the orientation of fixing belt 42 between heating roller 48 and tension roller 50, are provided. Downstream of nip portion N, which is the region at which fixing belt module 44 and pressure roller 46 are in a state of pressure-contact with each other, tension roller 60, around which fixing belt 42 is tensioned, is provided. A travel direction alteration member such as a release pad 58, which is a releasing member, is positioned adjacent to heating roller 48 downstream of nip portion N. Temperature sensor 43, which detects the temperature of fixing belt 42, is provided facing fixing belt 42 at a distance therefrom.

Figure 3:
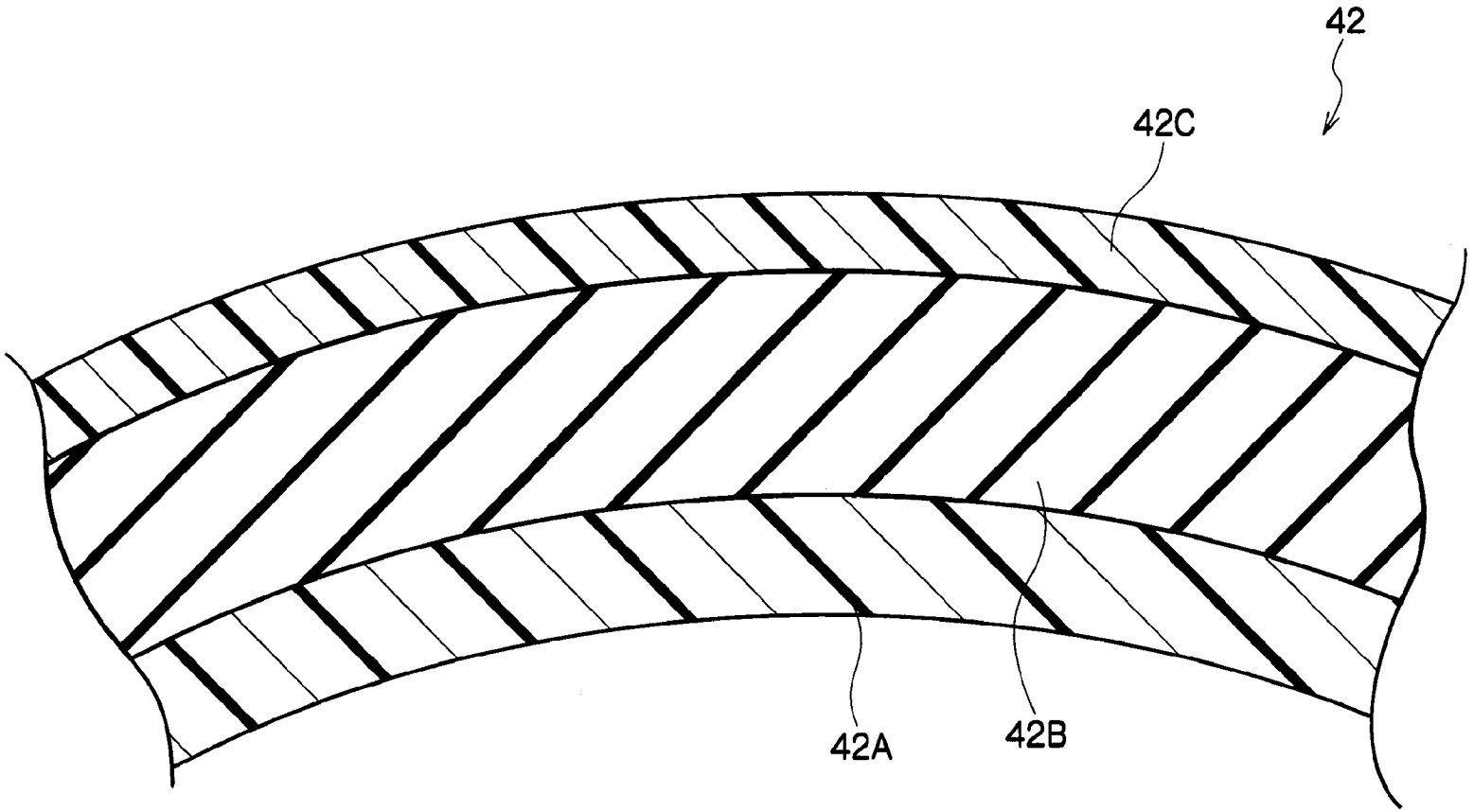
FIG. 3 is a sectional view of the fixing belt used in the fixing device according to the exemplary embodiment of the present invention.

As shown in FIG. 3, fixing belt 42 is a flexible endless belt configured by a base layer 42A formed from a polyimide resin at a thickness of 80 μm, elastic body layer 42B formed from silicon rubber at a thickness of 200 μm and layered on the surface side (outer peripheral surface side) of base layer 42A, and release layer (surface layer) 42C, which is a surface layer formed from a tetrafluoroethylene-perfluoroalkylvinyl ether copolymer resin (in the following, "PFA") tube at a thickness of 30 μm and covering elastic body layer 42B. With respect to the configuration of fixing belt 42, the materials, thicknesses, hardness and the like may be selected in accordance with design criteria for the device such as intended use and conditions of use.

Heating roller 48 shown in FIG. 1 is a hard roller comprising a cylindrical core roller (metal core) formed of aluminum and a fluorine resin film formed on the surface of the core roller at a thickness of 200 μm as a protective layer that prevents metallic wear of the core roller surface.

Halogen heater 62, which is a heating unit, is provided inside heating roller 48. Temperature sensor 49, which detects the surface temperature of heating roller 48 that is heated by halogen heater 62, is provided adjacent to heating roller 48.

Tension roller 50 is a cylindrical roller formed of aluminum and having halogen heater 64 provided as a heat source inside the roller, which heats fixing belt 42 from the inner surface side thereof. Further, spring members (not shown) that push fixing belt 42 toward an outer side thereof are provided at both ends of tension roller 50, and the total tensional force of fixing belt 42 is set at 15 kgf.

Tension roller 52 is a cylindrical roller formed of aluminum and a release layer formed of fluorine resin on the surface of tension roller 52 at a thickness of 20 μm. The release layer is formed in order to prevent tiny amounts of toner or paper debris from the outer peripheral surface of fixing belt 42 from accumulating on tension roller 52.

Halogen heater 66 is provided inside tension roller 52 as a heating means and heats fixing belt 42 from the outer peripheral surface side. That is, in the present exemplary embodiment, a configuration is adopted in which fixing belt 42 is heated by heating roller 48, tension roller 50 and tension roller 52.

Orientation correction roller 54 is a cylindrical roller formed of aluminum, and a belt edge position detection mechanism (not shown) that detects the position of an edge of fixing belt 42 is provided in the vicinity of orientation correction roller 54. Orientation correction roller 54 is provided with an axial displacement mechanism that alters the position at which fixing belt 42 contacts orientation correction roller 54 in the axial direction thereof in accordance with the results of the detection by the belt edge position detection mechanism, whereby meandering (belt walk) of fixing belt 42 is suppressed.

Release pad 58 is a block-shaped member formed, for example, from a metal such as SUS or a rigid body such as a resin and having a length that corresponds to that of heating roller 48. The sectional profile of release pad 58 substantially orthogonal to the longitudinal direction thereof has inside face 58A facing heating roller 48, pressing face 58B that presses fixing belt 42 toward pressure roller 46 and outside face 58C that has a predetermined angle with respect to pressing face 58B and bends fixing belt 42, such that the profile has a substantial arc shape.

Specifically, release pad 58 includes angle G, which is formed of pressing face 58B and outside face 58C, and angle H, which is formed of inside face 58A and pressing face 58B. Angle G causes bend of fixing belt 42, which is pushed against release pad 58 by pressure roller 46, as a result of which, when the leading edge of sheet member P passes the part of fixing belt 42 bent at angle G, the leading edge of sheet member P detaches from fixing belt 42.

The tensile force acting on release layer 42C (refer to FIG. 3) at the surface of fixing belt 42 pushed against and bent by angle G is larger than the tensile force or compressive force applied by any other member (i.e., heating roller 48, tension roller 60, tension roller 52, tension roller 50 or posture correction roller 54) and acting on release layer 42C at the surface of fixing belt 42.

Release pad 58 is swingably urged by an urging means such as a spring (not shown) and fixing belt 42 is pressed against pressure roller 46 at pressing face 58B with a predetermined load.

Tension roller 60 is a cylindrical roller formed of aluminum and is disposed downstream of release pad 58 in the direction of travel of fixing belt 42 such that fixing belt 42, having passed release pad 58, smoothly rotates to move towards tension roller 52.

Pressure roller 46 is a soft roller having cylindrical roller 46A formed of aluminum as a base body, and elastic layer 46B and a release layer layered in this order on the base body. Elastic layer 46B is formed from silicon rubber having a rubber hardness degree of 30° (JIS-A) and has a thickness of 10 mm, and the release layer is formed from a PFA tube at a thickness of 100 μm. Pressure roller 46 is supported so as to be freely rotatable and is press-contacted, by an urging means such as a spring (not shown), against a portion of heating roller 48 around which fixing belt 42 is wound. As a result, in conjunction with the rotary movement in the direction of arrow C of heating roller 48 of fixing belt module 44, pressure roller 46 is driven by heating roller 48 and rotates to move in the direction of arrow E. Further, press-contact/release device 68 is provided at the axis of rotation of pressure roller 46 as a press-contact/release unit that press-contacts pressure roller 46 against fixing belt module 44 and removes pressure roller 46 from contact with fixing belt module 44.

Further, drive control section 72, which controls the driving of motor 47 that causes heating roller 48 to rotate, and the driving of press-contact/release device 68, is provided.

Figure 2A:
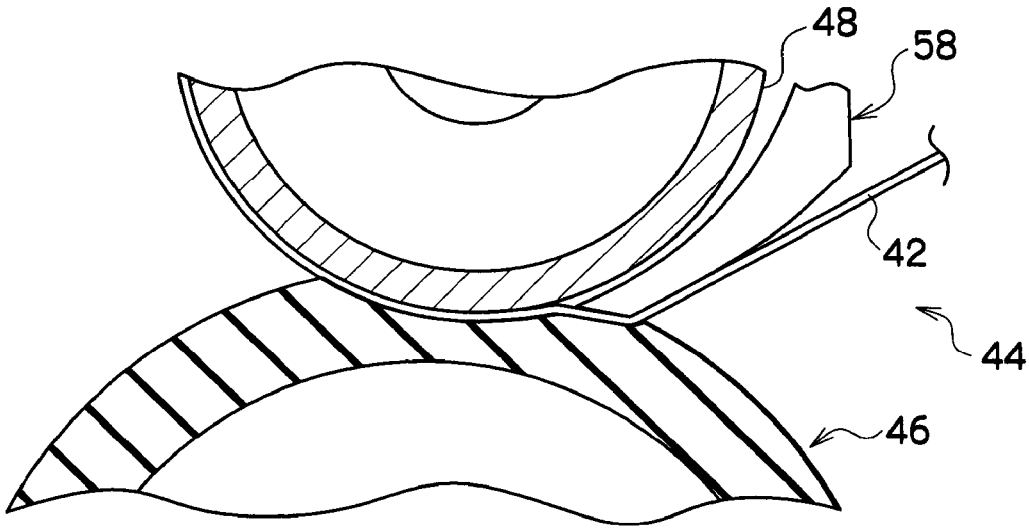
FIG. 2A and FIG. 2B are side views respectively showing a state in which the pressure roller and the fixing belt module used in the fixing device according to the exemplary embodiment of the present invention are press-contacted against each other and a state in which they are separated.
Figure 2B:
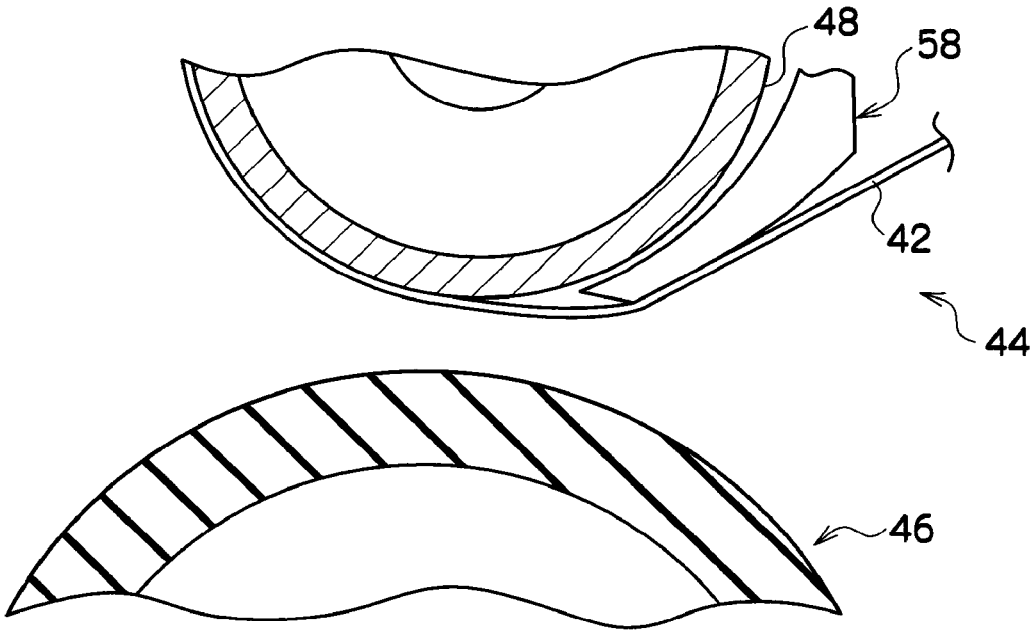

When fixing belt module 44 is in a quiescent state, drive control section 72 drives press-contact/release device 68 so as to remove pressure roller 46 from fixing belt module 44 (see FIG. 2B).

Further, drive control section 72 operates motor 47 and rotates heating roller 48 after heating roller 48 is heated, such that the yield stress of the material forming surface layer 42C of fixing belt 42 is larger than the stress acting on surface layer 42C when fixing belt 42 is bent at angle G of release pad 58.

In addition, drive control section 72, having rotated heating roller 48, is configured to press-contact pressure roller 46 against fixing belt module 44 using press-contact/release device 68 after fixing belt 42 is heated, such that the yield stress of the material forming surface layer 42C of fixing belt 42 is larger than the stress acting on surface layer 42C when fixing belt 42 is bent at angle G of release pad 58.

Figure 5:
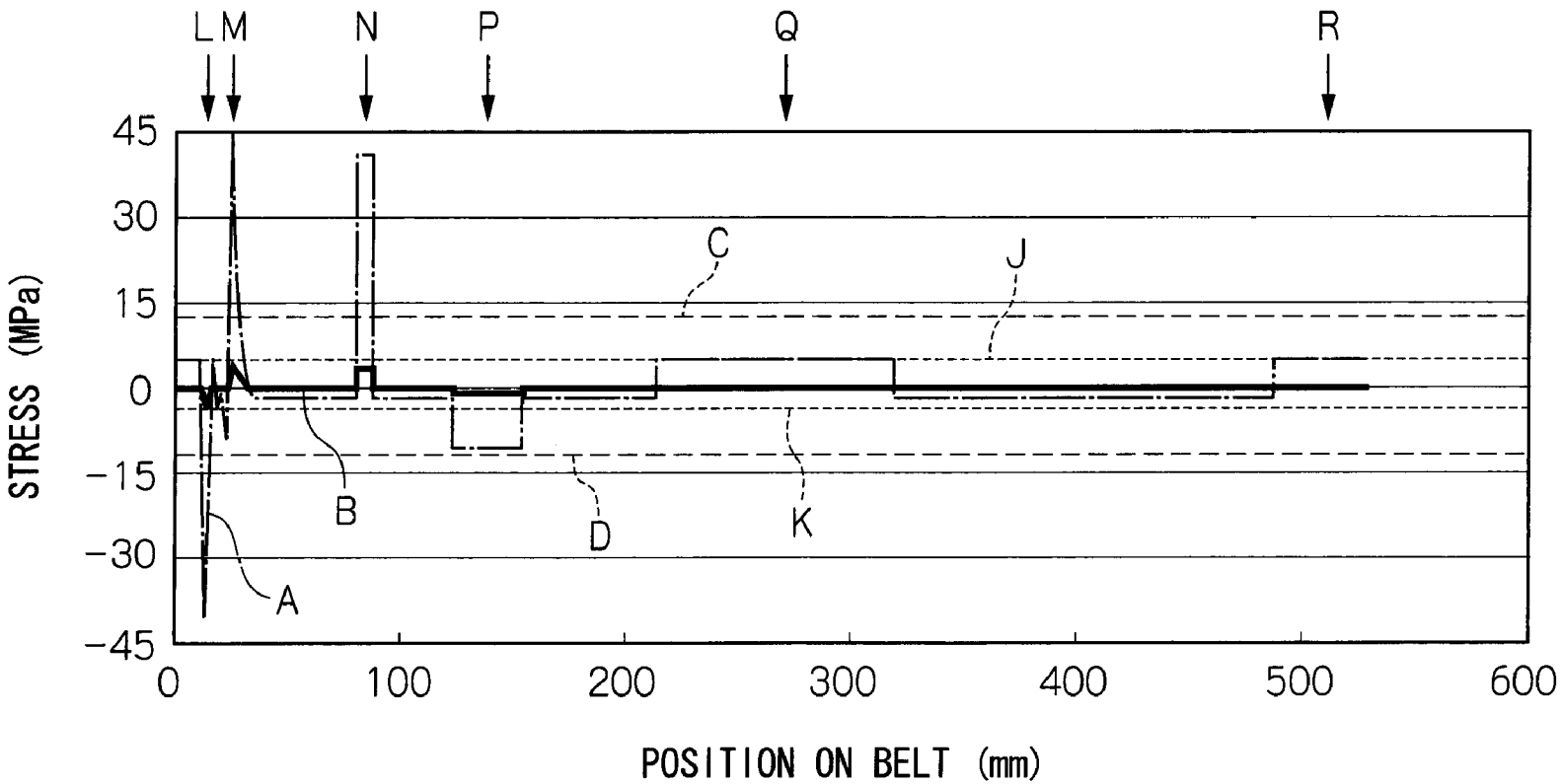
FIG. 5 is a graph showing the stress acting on a release layer of the fixing belt used in the fixing device according to the exemplary embodiment of the present invention.

FIG. 5 shows values of stress (MPa) acting on release layer 42C of fixing belt 42 as calculated from a simulation (analysis). Specifically, the vertical axis shows the stress (MPa) acting on release layer 42C and the horizontal axis shows the position on fixing belt 42. A negative stress value (MPa) indicates compression stress and a positive stress value (MPa) indicates tensile stress.

Broken line A (dashed-dotted line) indicates stress generated at release layer 42C when fixing belt 42 is at a temperature of 30° C., and broken line B (solid line) shows stress generated at release layer 42C when fixing belt 42 is at a temperature of 170° C. Further, straight lines C and D (dashed lines) show the yield stress when the material forming release layer 42C (PFA in the present exemplary embodiment) is at a temperature of 30° C., and straight lines J and K (dashed lines) show the yield stress when the material forming release layer 42C (PFA in the present exemplary embodiment) is at a temperature of 170° C.

The stress peak at portion L shown in FIG. 5 is a stress peak generated at release layer 42C when fixing belt 42 passes angle H of release pad 58 (refer to FIG. 1). The stress peak at portion M is a stress peak generated at release layer 42C when fixing belt 42 passes angle G of release pad 58 (refer to FIG. 1). The stress peak at portion N is a stress peak generated at release layer 42C when fixing belt 42 passes tension roller 60 (refer to FIG. 1). The stress peak at portion P is a stress peak generated at release layer 42C when fixing belt 42 passes tension roller 52 (refer to FIG. 1). The stress peak at portion Q is a stress peak generated at release layer 42C when fixing belt 42 passes tension roller 50 (refer to FIG. 1). The stress peak at portion R is a stress peak generated at release layer 42C when fixing belt 42 passes heating roller 48 (refer to FIG. 1).

That is, in the present exemplary embodiment, it can be seen that when fixing belt 42 reaches about 170° C., the yield stress (shown by straight lines J, K) of the material (PFA in the present exemplary embodiment) constituting release layer 42C is larger than the tensile stress (shown by broken line B) generated at release layer 42C of fixing belt 42 in a state in which pressure roller 46 is press-contacted against fixing belt module 44 as shown in FIG. 2A.

In other words, by heating fixing belt 42 to about 170° C., the yield stress of the material (PFA in the present exemplary embodiment) constituting release layer 42C becomes larger than the tensile stress generated at release layer 42C of fixing belt 42 and release layer 42C of fixing belt 42 is less easily damaged.

Figure 6:
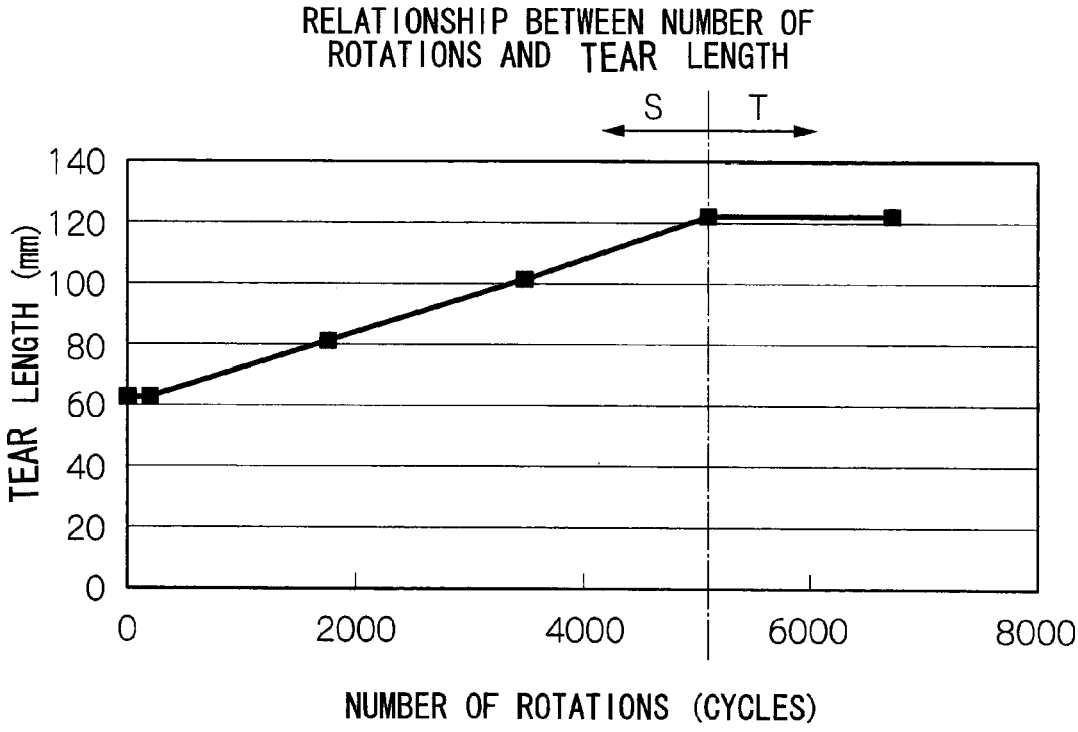
FIG. 6 is a graph showing the growth of a tear in a case in which the fixing belt used in the fixing device according to the exemplary embodiment of the present invention is damaged.

FIG. 6 shows values for the growth (extension) of a tear, as determined from experiments, when a tear is formed in release layer 42C of fixing belt 42. The vertical axis shows the length of the tear and the horizontal axis shows the number of rotations of fixing belt 42. Region S in FIG. 6 shows the growth of the tear when fixing belt 42 is 23° C., and region T shows the growth of the tear when fixing belt 42 is heated to 180° C. When the temperature of the fixing belt 42 is 23° C., the tear extends as the number of rotation of the fixing belt 42 is increased. Meanwhile, when the fixing belt 42 is heated to 180° C., the tear does not extend regardless of the increase of the number of rotation of the fixing belt 42.

That is, it can be seen that when fixing belt 42 is heated to about 180° C., if a tear is already formed in release layer 42C of fixing belt 42, the tear will not increase in size thereafter.

Mechanism

Next, the operation of fixing device 40, by which the toner image formed on sheet member P is fixed thereon, is explained.

Figure 4:
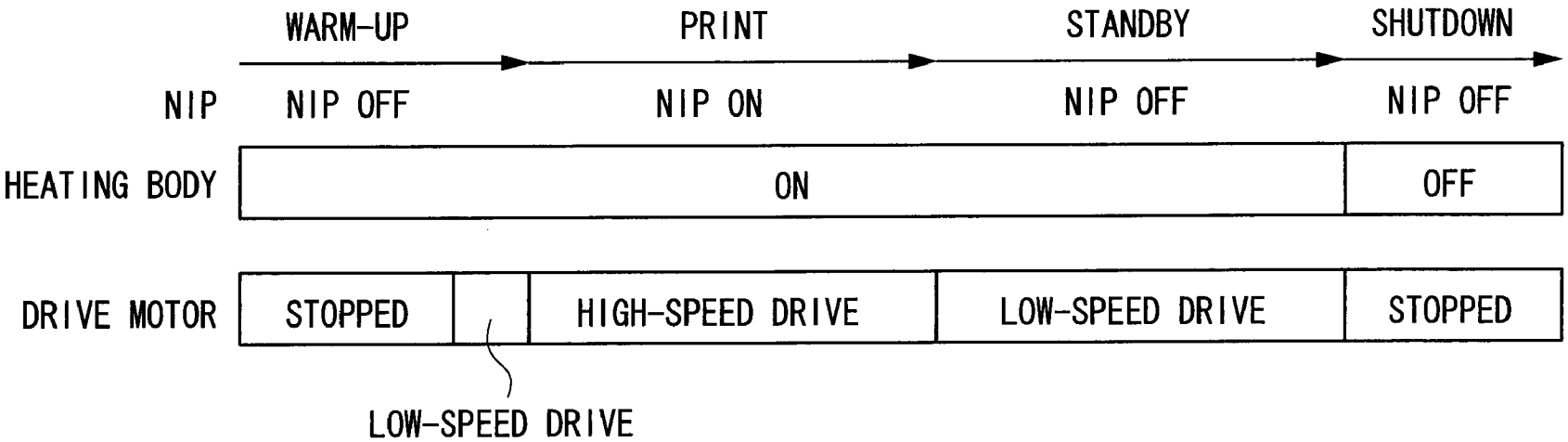
FIG. 4 is an explanatory diagram showing the operational conditions of the fixing device according to the exemplary embodiment of the present invention.

In a warm-up state as shown in FIG. 4, drive control section 72 shown in FIG. 1 operates press-contact/release device 68 so as to remove pressure roller 46 from contact with fixing belt module 44 as shown in FIG. 2B (a "nip OFF" state), and turns on the power sources of halogen heaters 62, 64, 66. By turning on the power sources of halogen heaters 62, 64, 66, heating roller 48, tension roller 50 and tension roller 52 are heated.

In addition, in order to enable fixing belt 42 to be heated to a temperature at which the yield stress of the material constituting surface layer 42C of fixing belt 42 is larger than the stress acting on surface layer 42C when fixing belt 42 is bent at angle G of release pad 58, drive control section 72 operates motor 47 and drives heating roller 48 at low speed only after determining, via temperature sensor 49, that heating roller 48 has been heated.

Then, drive control section 72, having initiated low-speed driving of heating roller 48, drives press-contact/release device 68 only after determining, via temperature sensor 43, that fixing belt has been heated to a temperature at which the yield stress of the material constituting surface layer 42C of fixing belt 42 will be larger than the stress acting on surface layer 42C when fixing belt 42 is bent at angle G of release pad 58, and press-contacts pressure roller 46 against fixing belt module 44 as shown in FIG. 2A (a "nip ON" state).

Then, drive control section 72 increases the drive force of motor 47 and drives heating roller 48 at high speed, thereby activating a print state in which a toner image can be fixed to sheet member P.

Further, when the print state is ended, drive control section 72 operates press-contact/release device 68 and removes pressure roller 46 from fixing belt module 44 as shown in FIG. 2B (nip OFF), and reduces the drive force of motor 47, driving heating roller at low speed in a standby state. That is, when not in a print state, pressure roller 46 is separated from fixing belt module 44 (nip OFF) and, therefore, fixing belt 42 is not in close contact with angle G and the tensile stress acting on release layer 42C of fixing belt 42 is alleviated.

Further, when the standby state is changed to a shutdown state, drive control section 72 turns off the power sources of halogen heaters 62, 64, 66, terminates driving of motor 47 and ends operations.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating roller that is internally provided with a heat source member and is rotated by a drive unit;

an endless fixing belt that is entrained around the heating roller and heated thereby, and is provided with a surface layer that contacts a recording medium, and the yield stress of a material forming the surface layer is varied according to the temperature of the material;

a pressure member that is provided facing the heating roller and presses the recording medium, on which a toner image has been formed, against the fixing belt;

a travel direction alteration member that contacts the fixing belt and changes the direction of travel of the fixing belt by bending the fixing belt;

a press-contact/release unit that press-contacts and separates the heating roller and the pressure member;

a drive control section that operates the drive unit and the press-contact/release unit; and a temperature sensor; wherein the drive control section operates the drive unit to rotate the heating roller at a low speed after the heating roller has been heated, and operates the press-contact/release unit so as to press-contact the heating roller and the pressure member after determining, via the temperature sensor, that the endless fixing belt has been heated by the heating roller to a predetermined temperature where the yield stress of the material forming the surface layer of the fixing belt is larger than the stress acting on the surface layer when the travel direction of the fixing belt is altered by the travel direction alteration member, and the drive control section operates the drive unit to drive the heating roller at a high speed after the press-contact/release unit has press-contacted the heating roller and the pressure member.

2. The fixing device of claim 1, wherein the travel direction alteration member is provided at a downstream side of a nip portion between the heating roller and the pressure member in a transport direction of the recording medium, and is a releasing member that separates the recording medium from the fixing belt.

3. The fixing device of claim 1, wherein the press-contact/release unit is a pressure member displacement device that displaces the pressure member and press-contacts and separates the heating roller and the pressure member.

4. An image forming device comprising:

an image formation unit that forms a toner image on a recording medium; and the fixing device of claim 1, which fixes the toner image formed by the image formation unit to the recording medium.

* * * * *